US008897692B2

(12) United States Patent
Kiriyama

(10) Patent No.: US 8,897,692 B2
(45) Date of Patent: Nov. 25, 2014

(54) IMAGE FORMING SYSTEM WHICH CONTROLS IMAGE FORMATION ON A BUNDLE OF SHEETS TO BE BOUND BY A RING BOOKBINDING SECTION

(75) Inventor: Tomohiro Kiriyama, Kofu (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 207 days.

(21) Appl. No.: 13/190,622

(22) Filed: Jul. 26, 2011

(65) Prior Publication Data

US 2012/0025440 A1 Feb. 2, 2012

(30) Foreign Application Priority Data

Jul. 29, 2010 (JP) ..... 2010-170184

(51) Int. Cl.

| | |
|---|---|
| ***G03G 15/00*** | (2006.01) |
| ***B65H 39/00*** | (2006.01) |
| ***B42B 5/08*** | (2006.01) |
| ***B42C 1/12*** | (2006.01) |
| ***B65H 39/10*** | (2006.01) |
| ***B42B 5/10*** | (2006.01) |
| ***B65H 37/04*** | (2006.01) |

(52) U.S. Cl.

CPC *B65H 39/10* (2013.01); *B42C 1/12* (2013.01); *B65H 2301/43825* (2013.01); *G03G 15/6544* (2013.01); *B42B 5/103* (2013.01); *G03G 15/6558* (2013.01); *G03G 15/50* (2013.01); *B65H 2801/48* (2013.01); *G03G 2215/00936* (2013.01); *B65H 2301/4381* (2013.01); *B65H 2301/4318* (2013.01); *B65H 2801/27* (2013.01); *B65H 37/04* (2013.01); *B65H 2551/18* (2013.01)

USPC ..... 399/408; 270/58.07; 270/58.08; 412/7; 412/42

(58) Field of Classification Search

USPC ..... 399/407–410; 412/7, 13, 19, 38–40, 4, 412/41–43; 270/58.07, 58.08; 271/9.01

See application file for complete search history.

(56) References Cited

U.S. PATENT DOCUMENTS

| | | | | |
|---|---|---|---|---|
| 5,124,731 | A * | 6/1992 | Knodt et al. | 347/129 |
| 7,677,549 | B2 * | 3/2010 | Kosugi | 271/9.13 |
| 7,726,928 | B2 * | 6/2010 | Kurabayashi et al. | 412/34 |

(Continued)

FOREIGN PATENT DOCUMENTS

| | | |
|---|---|---|
| JP | 2007-30319 A | 2/2007 |
| JP | 2008-505787 A | 2/2008 |

(Continued)

*Primary Examiner* — Matthew G Marini
*Assistant Examiner* — Justin Olamit
(74) *Attorney, Agent, or Firm* — Holtz, Holtz, Goodman & Chick PC

(57) ABSTRACT

An image forming system includes: a ring bookbinding section which perform a ring bookbinding to a bundle of sheets by using a binder provided with a spine portion and a plurality of finger portions; and a judging section, wherein a last page is firstly fed immediately after job initiation and, subsequently after having fed the last page, image formation based on the image data is initiated, when the judging section judges that an image is not formed on the last page, and wherein all of the image data is firstly acquired completely after job initiation, subsequently the last page is fed and formed image thereon, and then image formation of remaining pages is carried out, when the judging section judges that image is formed on the last page.

4 Claims, 8 Drawing Sheets

(56) References Cited

U.S. PATENT DOCUMENTS

| | | | | |
|---|---|---|---|---|
| 2008/0240887 | A1* | 10/2008 | Gotoh et al. | 412/4 |
| 2008/0298881 | A1 | 12/2008 | Todaro et al. | |
| 2009/0263212 | A1 | 10/2009 | Sasaki et al. | |
| 2010/0135713 | A1 | 6/2010 | Haramiishi et al. | |

FOREIGN PATENT DOCUMENTS

| | | | |
|---|---|---|---|
| JP | 2009-119712 | A | 6/2009 |
| JP | 2009-256070 | A | 11/2009 |
| JP | 2010-44429 | A | 2/2010 |
| WO | WO 2007/021578 | A2 | 2/2007 |

* cited by examiner

FIG. 2
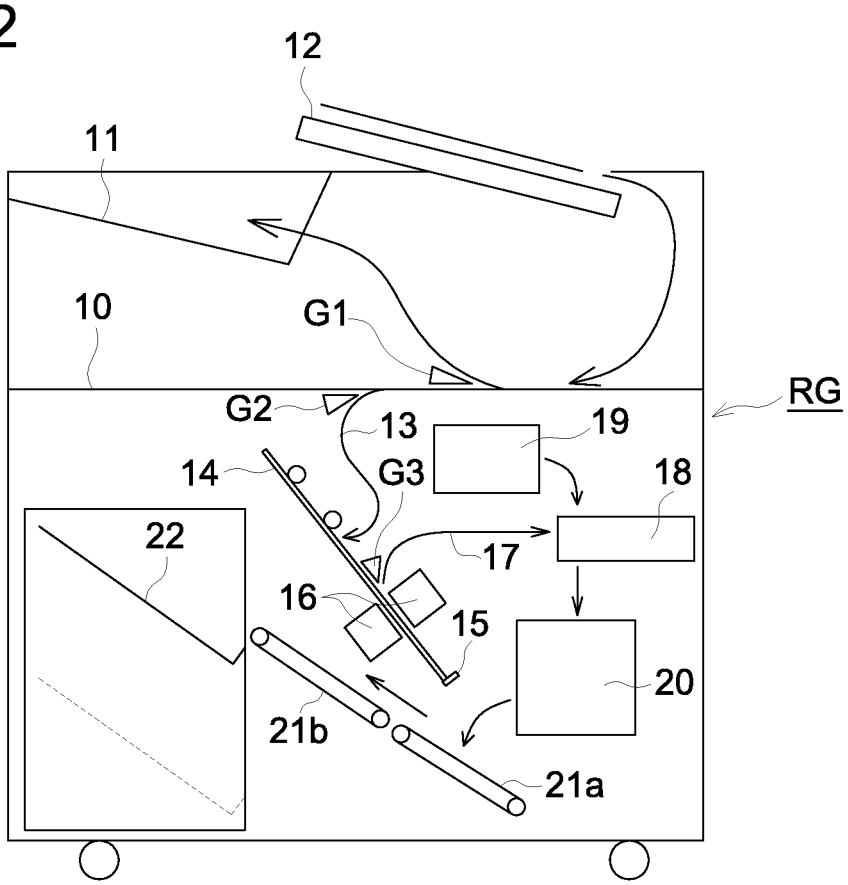
FIG. 3a
FIG. 3b
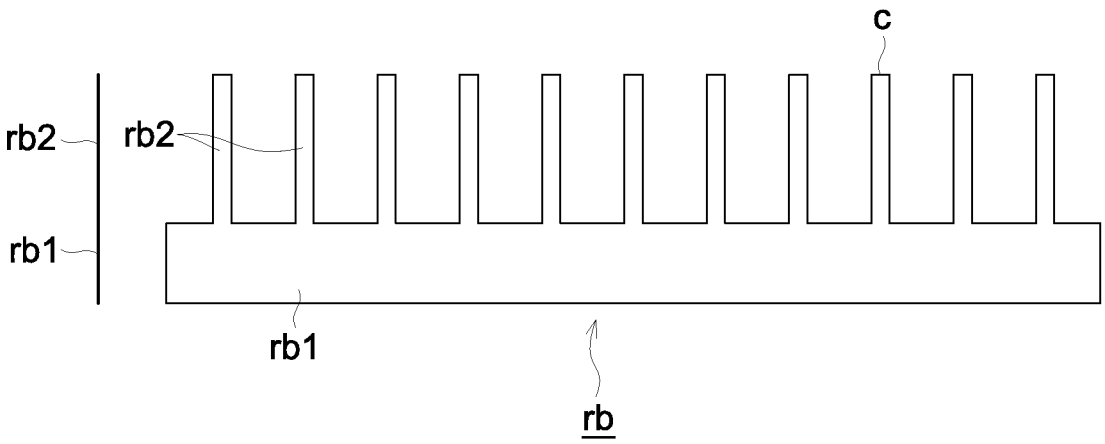

IMAGE FORMING SYSTEM WHICH CONTROLS IMAGE FORMATION ON A BUNDLE OF SHEETS TO BE BOUND BY A RING BOOKBINDING SECTION

RELATED APPLICATION

This application is based on Japanese Patent Application NO. 2010-170184 filed on Jul. 29, 2010 in Japanese Patent Office, the entire content of which is hereby incorporated by reference.

TECHNICAL FIELD

The present invention relates to an image forming system provided with a ring bookbinding apparatus in which a sheet bundle is bound using a ring binder.

BACKGROUND

Over recent years, an image forming system has not only simply carried out image formation, but also increased office work efficiency by providing a post-processing apparatus to carry out various kinds of post-processings. Such post-processings include, for example, punching processing, stapling processing, sheet-inserting processing to insert a cover sheet or an insert sheet, folding processing such as center-holding or tri-folding, and bookbinding processing.

As one of the bookbinding processings, there is ring-bookbinding processing. In this ring bookbinding processing, to a plurality of holes punched in a sheet bundle, a ring binder as shown in, for example, Unexamined Japanese Patent Application Publication No. 2007-30319 is attached, and then the rings are closed for ring binding of the sheet bundle to produce a booklet.

With regard to this ring bookbinding, various types of proposals have been made. For example, Unexamined Japanese Patent Application Publication No. 2009-256070 discloses a technology in which in an image forming system provided with a sheet inserting apparatus and a ring bookbinding apparatus, on ring binding processing, a judgment is made whether or not punch holes having been previously punched in a sheet are present; in the case of the presence of punch holes, the ring bookbinding apparatus is not allowed to punch punch holes, and in contrast, in the case of the absence of such punch holes, the punching function of the ring bookbinding apparatus punches punch holes.

Unexamined Japanese Patent Application Publication No. 2010-44429 discloses an image forming system in which in an image forming apparatus provided with a sheet inserting apparatus and a post-processing apparatus, on post-processing using an insert sheet, a non-image sheet standard mode to assign the inserting position of a sheet (image sheet) having an image formed on the basis of an insert sheet (non-image sheet) and an image sheet standard mode to assign the inserting position of a non-image sheet on the basis of a normal image sheet can be selectively used. This system intends to simplify the operation by instructing sheet insertion using the non-image sheet standard mode, when a large number of non-image sheets are handled Further, Japanese Translation of PCT International Application Publication No. 2008-505787 discloses another example of a ring binder (binding tool) used for ring bookbinding. The ring binder disclosed in Japanese Translation of PCT International Application Publication No. 2008-505787 has such a structure that a spine portion and a plurality of finger portions extending from the spine portion are provided and the finger portions are inserted into the punch holes of a sheet bundle and rolled for connection to the spine portion to form a rolled ring binder.

Japanese Translation of PCT International Application Publication No. 2008-505787 discloses that, between the rear cover (last sheet) and the last sheet of the main body sheets, a spine portion is arranged and then the spine portion is covered to provide an attractive appearance for a bound book. Since the finger portions are rolled with a length based on the thickness of the sheet bundle, the length is formed longer with some allowance. Therefore, in a common binding method, on the rear cover side, the spine portion and the long finger portions appear, resulting in disfigurement. Japanese Translation of PCT International Application Publication No. 2008-505787 intends to cover such a spine portion and finger portions by the rear cover. Further, WO/2007/021578 discloses an apparatus constitution to carry out ring bookbinding employing the ring binder of Japanese Translation of PCT International Application Publication No. 2008-505787.

To arrange a spine portion between the rear cover and the last page of a sheet bundle as described in Japanese Translation of PCT International Application Publication No. 2008-505787 and WO/2007/021578, as the order of feeding sheets to a ring bookbinding apparatus, initially, the last sheet serving as the rear cover is fed and then main body sheets with images formed are successively fed to carry out ring bookbinding, and then the rear cover of the finished booklet is turned over to be positioned on the rear side of the main body sheets.

Further, Unexamined Japanese Patent Application Publication No. 2009-119712 discloses a ring binder similar to that of Japanese Translation of PCT International Application Publication No. 2008-505787.

The present invention relates to the control of image formation in the case where ring bookbinding disclosed in above Japanese Translation of PCT International Application Publication No. 2008-505787 and WO/2007/021578 is carried out in which a spine portion is arranged between the final sheet (rear cover) and the last sheet of the main body sheets.

In general, an original document is set on the automatic document reading apparatus and then an original image is read to carry out image formation. However, the presence or absence of an image in the last original document is unclear until termination of original document reading. Therefore, to arrange a spine portion between the rear cover and the last sheet of the main body sheets as described in Japanese Translation of PCT International Application Publication No. 2008-505787 and WO/2007/021578, after the complete termination of original document reading, a judgment whether or not an image to be printed is present in the last original document is made, and thereafter image formation is initiated.

To further detail this respect, an example of a booklet bk produced using a ring binder provided with a spine portion is shown in FIGS. 8*a* and 8*b*. FIG. 8*a* is a perspective view showing the state of a booklet bk immediately after produced. In this state, exposure of the spine portion on the surface results in poor appearance. To circumvent this problem, it is possible that the user turns over a sheet at the bottom via one-sheet flipping to create the completed state of FIG. 8*b*. The sheet S flipped in this case is used as the rear cover.

FIGS. 9*a*, 9*b* and 9*c* are schematic views illustrating the printing order in an image forming system to produce a booklet of the state as shown in FIG. 8*a*. FIG. 9*a* is a view showing the order of original document reading. FIG. 9*b* is a view showing the order of printing image data obtained via reading. FIG. 9*c* is a view showing the state when sheets were stacked in a stacking section in the order of printing and thereby a sheet bundle was produced to carry out bookbinding for the thus-produced sheet bundle using a ring binder rb. Further, the arrow shown in FIG. 9*a* shows the position when the spine portion rb1 of the ring binder rb is inserted.

To obtain a booklet bk as shown in FIGS. 8*a* and 8*b*, as shown in FIG. 9*c*, the last, nth sheet is placed as the bottom layer, and thereon, the (n−1)th sheet is stacked in the order from the first sheet to produce a sheet bundle. Then, a ring binder rb is attached to the thus-produced sheet bundle to produce a booklet bk as shown in FIG. 8*a*. Namely, as the printing order, as shown in FIG. 9*b*, initially, image data of page n is printed on the nth sheet and then image data is printed on sheets starting from the first sheet to the (n−1)th sheet in this sequential order.

On the other hand, as shown in FIG. 9*a*, original document reading is carried out in the order from the first page (first sheet) to the nth page (nth sheet), but the printing order is as follows: the nth sheet, the first sheet, the second sheet, . . . , and the (n−1)th sheet.

As shown in FIG. 9*a*, original document reading of the last, nth sheet is terminated last. Therefore, without termination of entire original document reading, image formation cannot be initiated, resulting in low productivity.

In view of these circumstances, an object of the present invention is to provide an image forming system capable of initiating image formation before terminating the acquisition of the entire image data and of reducing the entire processing time of image formation.

SUMMARY OF THE INVENTION

To achieve at least one of the above mentioned objects, an image forming system reflecting one aspect of the present invention has: a sheet feeding section which feeds sheets; an image data acquisition section which acquires image data of a plurality of pages; an image forming section which carries out image formation on sheets based on the image data; a ring bookbinding section which performs a ring bookbinding to a bundle of sheets by using a ring binder provided with a spine portion and a plurality of finger portions; a judging section which judges whether or not image is formed on a last page of the bundle of sheets based on the acquired imaged data when a ring bookbinding is ordered to be performed; and a control section which controls the sheet feeding section and the image forming section, so that, in a case when the judging section judges that image is not formed on the last page, a sheet to be a last page is firstly fed immediately after job initiation and, subsequently after having fed the sheet, image formation based on the image data is initiated, and so that, in a case when the judging section judges that image is formed on the last page, all of the image data is firstly acquired completely after job initiation, subsequently a sheet to be the last page is fed and formed image thereon, and then image formation of remaining pages is carried out.

BRIEF DESCRIPTION OF THE DRAWINGS

FIG. 2 is a sectional view of a ring bookbinding apparatus according to the present invention;

FIGS. 3*a* and 3*b* are views showing a ring binder rb before processed;

PREFERRED EMBODIMENT OF THE INVENTION

Figure 1:
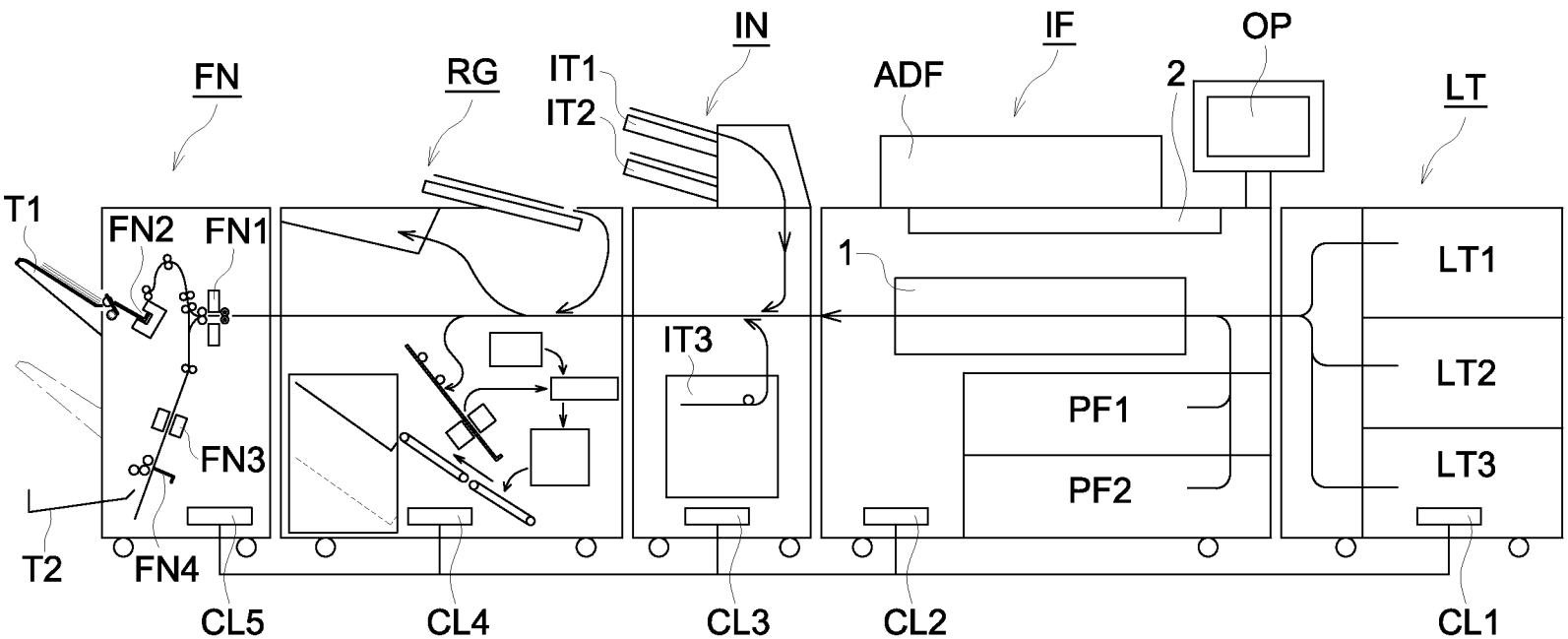
FIG. 1 is a partial sectional view showing an image forming apparatus to which the present invention is applied.

FIG. 1 is a partial sectional view showing an image forming system to which the present invention is applied. This image forming system is a system in which from the right side of the figure, a large volume sheet feeding apparatus LT, an image forming apparatus IF, a sheet inserting apparatus IN to insert a cover sheet and a dividing sheet into a sheet bundle, a ring bookbinding apparatus RG according to the present embodiment, and a finishing apparatus FN to carry out various post-processings are connected.

The large volume sheet feeding apparatus LT has three-stage sheet feeding trays LT1, LT2, and LT3 and feeds sheets to the image forming apparatus IF.

The image forming apparatus IF is equipment to carry out image formation using an electrophotographic system or an offset printing system and has an image forming section 1, two-stage sheet feeding trays PF1 and PF2, an automatic document feeding apparatus ADF, a scanner 2, and an operation display section OP serving as a display input member.

The image forming section 1 carries out image formation (printing) on sheets, for example, using an electrophotographic system. The image forming section 1 employing such an electrophotographic system incorporates a photoreceptor drum, a charging device, a developing device, a transfer device, a fixing device, and a cleaning device and forms monochrome or full-color images.

The sheet inserting apparatus IN is provided with 3 sheet inserting trays IT1, IT2, and IT3 in total including 2 stages on the upper side and one stage in the interior, and therein cover or dividing sheets having different color and thickness can be set. In response to an instruction having been input from the operation display section OP or a piece of sheet inserting information contained in a printing instruction from a computer connected to a network, the above sheets are inserted into predetermined positions of a sheet bundle.

Further, the finishing apparatus FN has a punching section FN1 to punch 2 holes for filing, a side stitching section FN2 to carry out side stitching, a saddle stitching section FN3 to carry out saddle stitching, and a folding section FN4 to carry out center-folding or tri-folding of sheets, and carries out various types of post-processings for sheets to be discharged onto the elevating tray T1 or the lower tray T2.

These apparatuses have control sections CL1-CL5 each correspondingly and carry out image formation and post-processings to be described later while communicating via communication lines.

Incidentally, it goes without saying that the above image forming system is just an example and another constitution is also employable.

FIG. 2 is an enlarged sectional view of the ring bookbinding apparatus RG shown in FIG. 1. With reference to FIG. 2, an example of the constitution of the ring bookbinding apparatus will be schematically described. However, it goes without saying that the ring bookbinding apparatus can have another constitution with no limitation to this example.

Herein, initially, a ring binder rb used in the ring bookbinding apparatus RG will be described. FIGS. 3*a* and 3*b* are views showing a ring binder rb before processed. FIG. 3*a* is a top view and FIG. 3*b* is a side view. As shown in FIGS. 3*a* and 3*b*, a sheet-shaped ring binder rb before subjected to processing such as folding is a flat plate incorporating a spine portion rb1 and a plurality of finger portions rb2 extending from a long side of the former in the vertical direction. As a material therefor, a resin film of a polyester or cellulose ester is usable. The flat plate finger portions rb2 shown in FIGS. 3*a* and 3*b* are curved/folded into a cylindrical shape to form a ring rg.

Figure 4A:
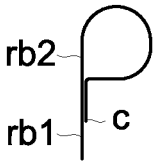
FIGS. 4*a* and 4*b* is a view showing the ring binder rb after processed.
Figure 4B:
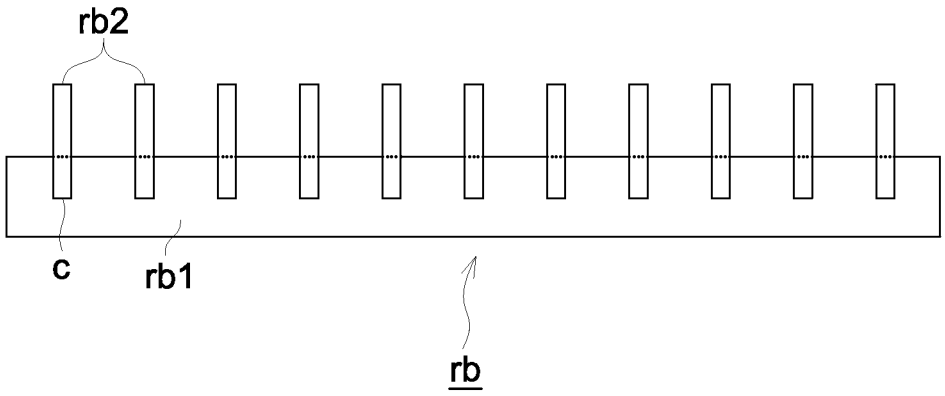

FIG. 4*a* and FIG. 4*b* are views showing a ring binder rb after processing of the sheet-shaped member shown in FIGS. 3*a* and 3*b*. A portion with a predetermined length from the tip c of each finger portion rb2 is bonded to the spine portion rb1 using an adhesive. Thereby, the ring binder rb becomes in the state where a plurality of rings are arranged along the long side of the spine portion rb1.

Now, description will be returned to FIG. 2.

In FIG. 2, a sheet conveyance path from the sheet inserting apparatus IN is connected to the horizontal conveyance path 10 horizontally crossing the ring bookbinding apparatus RG. The switching gates G1 and G2 placed in the horizontal conveyance path 10 can switch the conveyance path.

In the case of no post-processing, the switching gate G1 allows a sheet to be conveyed to the upper conveyance path to discharge the sheet onto a sheet discharging tray 11. Further, when a conveyed sheet is not processed by the ring bookbinding apparatus RG but post-processed on the downstream side, it is possible that the sheet is conveyed by the switching gates G1 and G2 in a straight manner to be conveyed to the post-processing apparatus FS on the downstream side. And, when bookbinding processing is carried out with a ring binder rb using the ring bookbinding apparatus RG, a sheet is conveyed by the switching gate G2 to the lower conveyance path. Further, on top of the ring bookbinding apparatus RG, a sheet feeding tray 12 is placed. When off-line bookbinding is carried out, sheets are successively fed from this sheet feeding tray 12 to be joined in the horizontal conveyance path 10.

The bookbinding conveyance path 13 branched downward from the center of the horizontal conveyance path 10 is a conveyance path to convey a sheet to be subjected to ring bookbinding. The sheet is passed through this conveyance path 13, followed by being conveyed temporarily upward on a tray 14 obliquely arranged, and when the rear end of the sheet goes off the bookbinding conveyance path 13, the sheet goes down along the tray 14 and then touches the stopper 15 to stop.

The stopper 15 is movable along the tray 14 and stops a sheet at the position where the front end of the sheet is inserted into a punching mechanism 16 placed nearly in the center of the tray 14.

The punching mechanism 16 is a well-known mechanism incorporating punches and dies, in which these punches and dies are arranged in the vertical direction with respect to the sheet plane with a required number thereof enabling to punch a plurality of punch holes for ring bookbinding to form punch holes by punching a sheet remaining stopped by the stopper 15. After punch hole formation, the stopper 15 temporarily moves down to the lowermost position of the tray 14.

Incidentally, when ring bookbinding is carried out, a sheet having punch holes previously formed are often used. In such a case, the stopper 15 moves down to the lowermost position of the tray 14 to stop a sheet. A sensor, not shown, placed in the conveyance path can detect whether or not a sheet is one having punch holes previously formed. Alternatively, an instruction for the presence of punch holes may be input by the operation display section OP.

Subsequently, a sheet with punch holes formed by the punching mechanism 16 or a sheet with previously formed punch holes moves up along the tray 14 via elevation of the stopper 15 to be sent to a binding conveyance path 17 by the gate G3.

In the downstream of the binding conveyance path 17, a stacker 18 is placed to store sheets to be sent in. Such sheets are successively stacked in this stacker 18 so that the long sides thereof with punch holes formed are placed on the left side of the figure.

After termination of storage of a sheet bundle for one set, a ring binder rb is taken out from the cartridge 19 of the upper left side of the stacker 18 to insert the finger portions thereof into the punch holes of the sheet bundle. In the cartridge 19, a plurality of flat plate ring binders rb are stacked and stored, and therefrom, one ring binder rb is taken out. When the cartridge 19 has become empty, the entire cartridge is replaced with a new one.

Next, a sheet bundle having a ring binder rb is passed to a binder 20 on the lower side, and then using this binder 20, the finger portions rb2 of the ring binder rb are curved/folded in a ring manner to allow the predetermined positions of the finger portions rb2 to be bonded/fixed to the spine portion rb1. A booklet in this state is one shown in FIGS. 8*a* and 8*b*. The finger portion position to be subjected to adhesion/fixing is variable depending on the thickness of a sheet bundle, and adjusted so that an appropriate ring diameter is formed corresponding to the thickness of a booklet.

In this manner, a booklet having been subjected to ring bookbinding is conveyed to a tray 22 by belt conveyers 21*a* and 21*b*. The tray 22 can move up and down and stack a large number of booklets. The portion with a square line surrounding the tray 22 is constituted so as to be withdrawn from the ring bookbinding apparatus RG and thereby the operator removes a finished booklet.

Figure 8A:
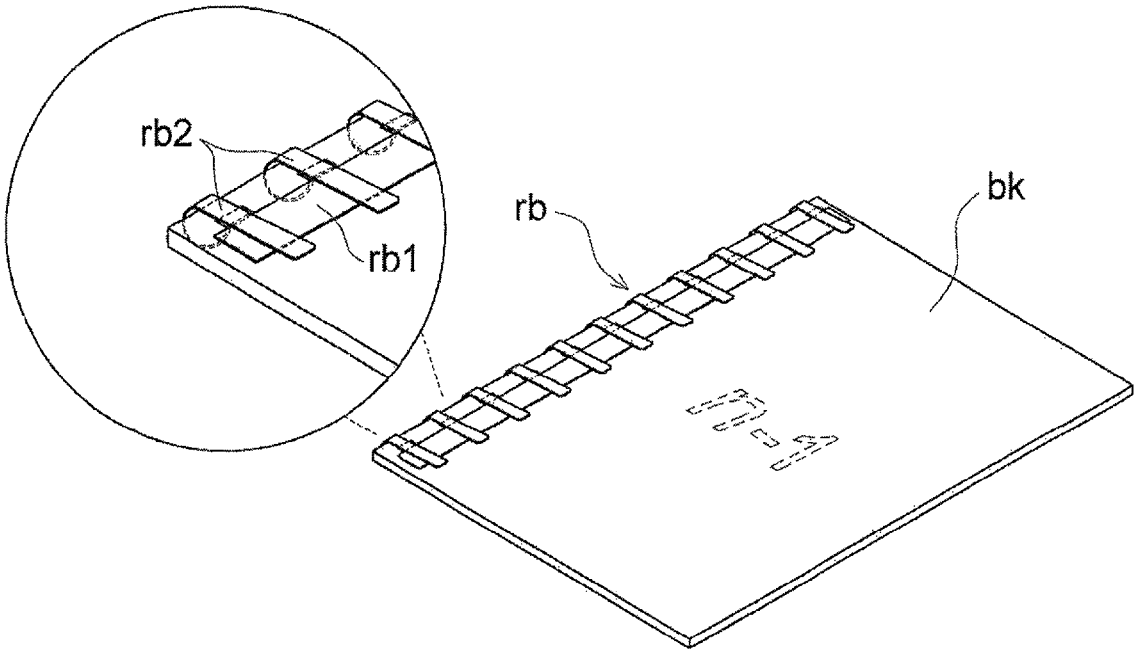
FIG. 8a PRIOR ART
FIG. 8*a* is a perspective view showing a booklet book-bound using a ring binder and FIG. 8*b* is a main portion sectional view showing the booklet book-bound using the ring binder.
Figure 8B:
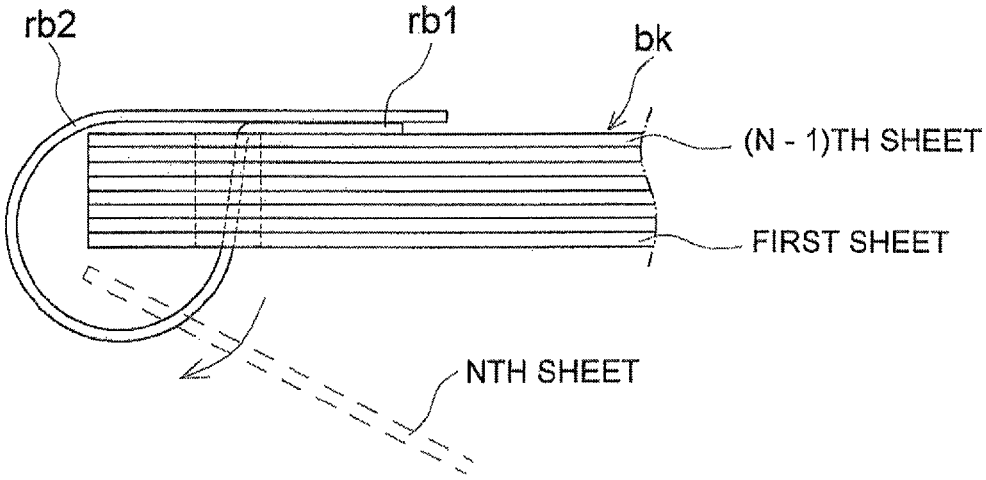
FIG. 8b PRIOR ART
Figure 9A:
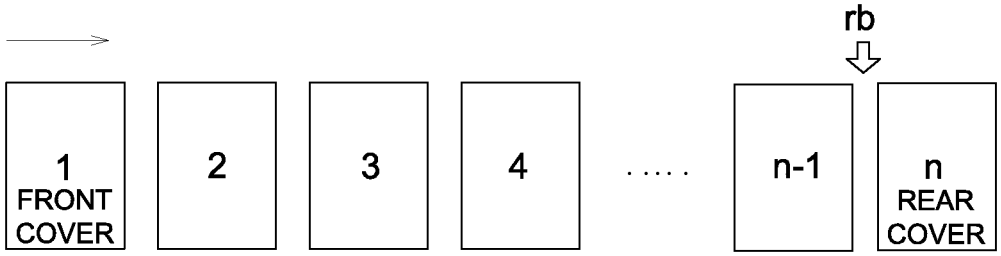
FIG. 9*a* is a schematic view showing the order of original document reading.
Figure 9B:
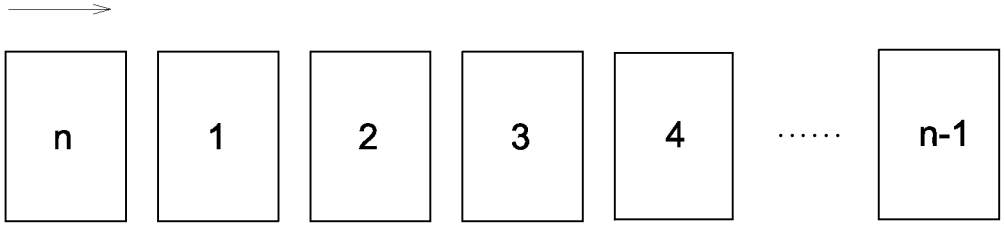
FIG. 9*b* is a schematic view showing the printing order.
Figure 9C:
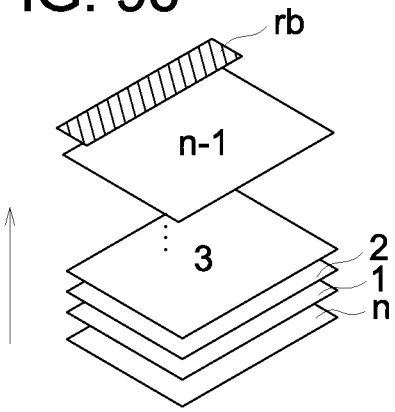
FIG. 9*c* is a schematic view showing the stacking order and the position of the spine portion.

As shown in FIG. 8*a*, a booklet having been subjected ring bookbinding is in the state where the spine portions rb1 and the finger portions rb2 having been bonded thereto appear on the surface. At this time, the sheet of the front side of the figure is the (n−1)th sheet and the bottom sheet is the rear cover which is the nth sheet. In this state, the rear cover is turned over by the operator as shown with the two-dot chain line in FIG. 8*b* to allow the rear cover to be on the surface side. Thereby, the spine portion rb1 and the finger portions rb2 are covered with the rear cover to allow the appearance of the booklet to be beautiful.

Via the above constitution, the ring bookbinding of the present embodiment is carried out. In the present embodiment, controlling is carried out so as to minimize the required time for successive storage in the stacker in which a rear cover is initially sent out and stored in a stacker and thereafter image formation is carried out from the top page.

Figure 5:
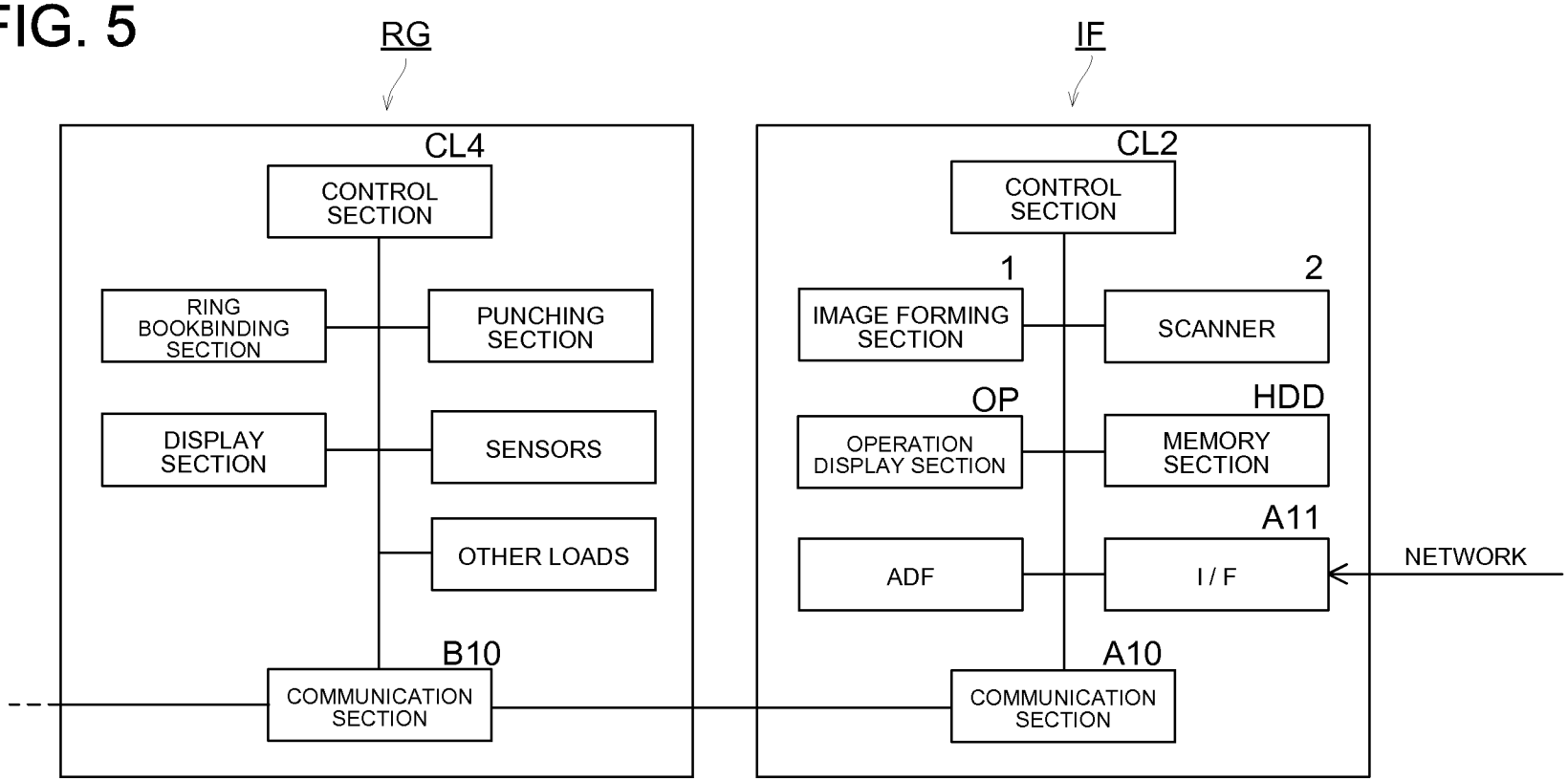
FIG. 5 is a control block diagram showing the main section of the image forming system according to the present invention.

A control block diagram to carry out this control is shown in FIG. 5 to be described below. Incidentally, in the figure, only the control section CL2 of the image forming apparatus and the control section CL4 of the ring bookbinding apparatus RG deeply relating to the operational description of the present embodiment are shown. Other well-known sections in the image forming system are omitted.

The image forming apparatus IF is provided with a control section CL2, an image forming section 1, a scanner 2, an operation display section OP, a memory section HDD incorporating a hard disk, a communication section A10, and an interface A11.

The control section CL2 has a CPU, a ROM, and a RAM, as well as other peripheral devices, and executes various controls of the image forming apparatus IF. A11 is an interface (I/F) as a communication member to carry out communications via a network such as LAN. Further, via the interface A11, a print job containing image data is received from an external computer connected to the network and then the print job is temporarily memorized in the memory section HDD to carry out image formation.

The operation display section OP is a touch panel in which touch screen operation sections are layered on the display section incorporating a liquid crystal panel. The operation display section OP can display various kinds of operation screens.

From the operation display section OP, a print job is set by the operator and various displays based on the settings are carried out. Herein, the print job settings include the size of a sheet used, the sheet feeding tray, the number of printed sheets, the double-sided or single-sided mode, the type of post-processing, and the presence or absence of an inserted sheet. In the case of ring bookbinding processing, the type of post-processing includes the number of sheets (thickness) to be formed into a booklet, the type of a ring binder rb used, and the adhesion position of the finger portions rb2. The scanner 2 or the scanner 2 and the automatic document feeding apparatus ADF and I/F (A11) function as an image data acquisition section to acquire image data in the order of pages.

A10 is a communication section, being connected at least to the ring bookbinding apparatus RG, and transmits and receives various data between this section and the ring bookbinding apparatus RG.

The ring bookbinding apparatus RG is provided with a control section CL4, a punching section, a ring bookbinding section, various sensors, and other loads, as well as a display section and a communication section B10. The control section CL4 has the same constitution as the control section CL2 and executes various controls of the ring bookbinding apparatus RG based on the program. The communication section 10 is connected to the communication section A10 of the image forming apparatus IF, transmitting and receiving various data between this section and the image forming apparatus IF.

The display section is not shown in FIG. 1 or FIG. 2, incorporating a liquid crystal display, and displays various states of the ring bookbinding apparatus RG. Further, when the ring bookbinding apparatus RG is used off-line, necessary information can be input from an unshown input section by seeing a display of the display section.

Next, with reference to the flowchart of FIGS. 6*a* and 6*b*, the control flow according to the ring bookbinding processing of the present embodiment will be described.

To carry out ring bookbinding and then cover the spine portion with the rear cover, a sheet of the last page used as the rear cover must be firstly fed. Conventionally, a judgment whether or not image formation is carried out on this sheet of the last page has been made after reading in image data for the last page.

In this embodiment, this is judged at first. Then, in the case of no image formation on the last sheet, immediately after job initiation, a sheet of the last page is fed and subsequently image formation is initiated for another sheet. Incidentally, in the present embodiment, the job initiation means that in the case of carrying out image formation by reading an original image using a scanner, after print job setting, the image formation start button is pressed to initiate reading of the original image. Further, it is meant that in the case of receiving image data via a network, reception of image data containing the setting content of a print job is initiated.

Figure 6A:
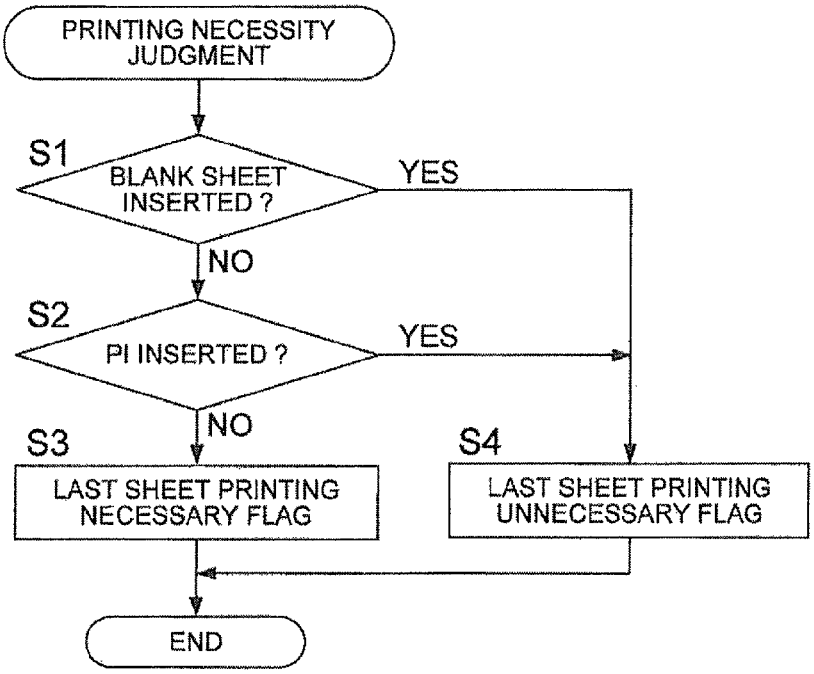
FIGS. 6*a* and 6*b* are flowcharts showing the control flow according to the ring bookbinding apparatus of the present invention.
Figure 6B:
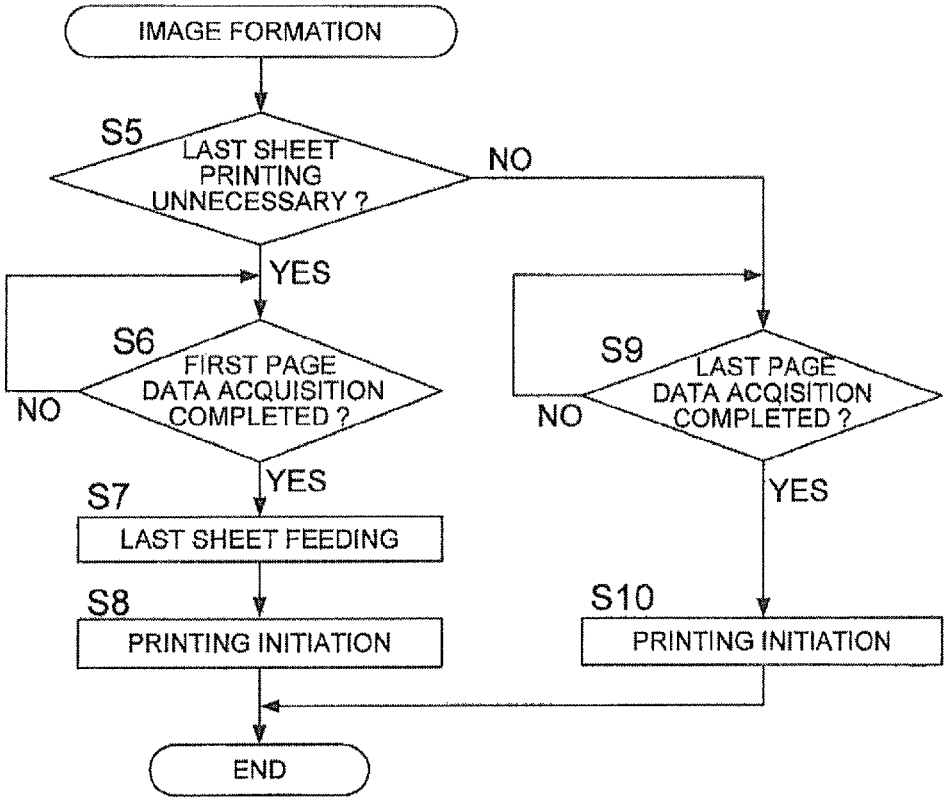
Figure 7:
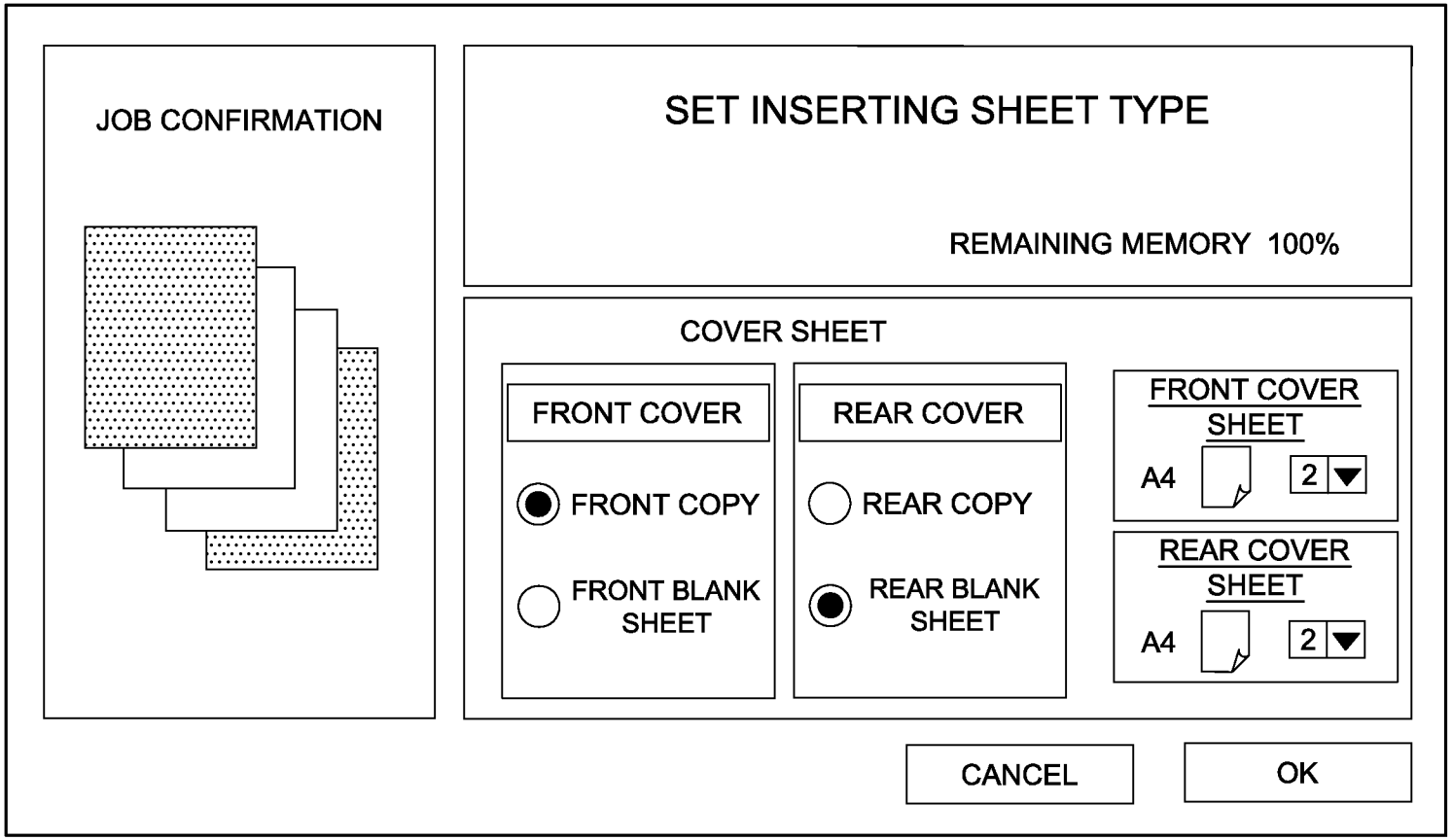
FIG. 7 is a view showing the cover sheet setting screen of an operation display section according to the present invention.

FIGS. 6*a* and 6*b* views explaining the control flow executed by the control section A10 of the image forming system according to the embodiment. FIG. 7 is an example of the setting screen displayed in the operation display section OP.

FIG. 6*a* shows a subroutine to make a judgment of necessity of printing for last sheet, and FIG. 6*b* shows a subroutine to control the initiation of image formation based on this judgment.

The subroutine of FIG. 6*a* is a process carried out at first after the instruction of image formation has been received, judging, initially, whether or not blank sheet insertion has been set at step S1. The blank sheet insertion refers to a setting in which from the sheet feeding section of upstream of the image forming section, that is, from any of the sheet feeding sections (LT1-LT3, PF1, and PF2), one blank sheet to be subjected to no image formation is fed to allow this sheet to serve as the rear cover.

This setting is carried out in the cover sheet setting screen of the operation display section OP shown in FIG. 7. In the cover sheet setting screen, "REAR BLANK SHEET" below "REAR COVER" is selected, and then in "REAR COVER SHEET" on the right side thereof, a desired sheet feeding section is selected using the pulldown menu. In this example, the sheet feeding section 2 is selected for front cover sheet and rear cover sheet. This process carries out blank sheet insertion setting. Incidentally, the front cover can be set in the same manner. Further, when an image is formed on the front or rear cover, "FRONT COPY" or "REAR COPY" needs only to be selected, respectively.

Herein, FIG. 7 shows the setting screen of the operation display section OP. However, in the print setting screen of a computer, the same setting can be carried out. Since this setting data is sent together with image data, judgments of step S1 and S2 of FIG. 6*a* can be performed also with respect to the sent setting data in the same manner.

Subsequently, at step S2, the judgment of the presence or absence of sheet insertion from the sheet inserting apparatus IN is made. Since the sheet inserting apparatus IN is placed in the downstream of the image forming apparatus IF, no image formation in the image forming apparatus IF is required.

In the case of "No" in both of step S1 and step S2, since image formation is necessary, at step S3, a flag for the necessity of printing on the last sheet is set. On the other hand, in the case of "Yes" in either step S1 or step S2, since printing on the last sheet in the image forming apparatus IF is unnecessary, a flag therefor is set.

After the subroutine of FIG. 6*a*, the subroutine of FIG. 6*b* to control initiation of image formation is executed.

In this subroutine, initially, at step S5, the flags having been set at previous step S3 and S4 are checked to judge whether or not printing on the last sheet is unnecessary. When the judgment of step S5 is "Yes," namely, in the case of blank sheet insertion or when whether an insert sheet is inserted from the sheet inserting apparatus IN is selected and printing on the last sheet is unnecessary, a judgment on the termination of acquisition of image data of the first page is made at following step S6. In the case of termination, at step S7, the last sheet is fed and then at step S8, printing as a job is initiated. Acquisition of image data for the second page and the following pages is carried out concurrently with printing, and successively, image formation is performed.

On the other hand, in the case of "No" at step S5, namely, when printing is also carried out on the last sheet, at step S8, the completion of acquisition of image data up to the last page is awaited, and after completion, at step 9, printing as a job is initiated. Initially, the last sheet is fed for printing, and thereafter, sheets are successively fed for printing in the order from the first page.

As described above, when image formation on the last sheet is unnecessary, immediately after initiation of a job, printing is initiated, whereby the entire processing time can be reduced.

In the embodiment described above, with regard to the last sheet, via blank sheet insertion or insertion from the sheet inserting apparatus, the judgment of unnecessity of image formation on the last sheet has been made. However, when the same judgment is made in cases other than this, the present invention can be carried out. Further, the ring binder has been shown as an example by use of that of Japanese Translation of PCT International Application Publication No. 2008-505787. However, even by use of the ring binder of Unexamined Japanese Patent Application Publication No. 2009-119712 or the ring binder of Unexamined Japanese Patent Application Publication No. 2007-30319, the present invention can be carried out.

According to the present embodiment described above, the present invention makes it possible that in the case of no image formation on the last sheet, before termination of the entire image data acquisition, image formation is initiated, and thereby the productivity of a booklet subjected to ring bookbinding is enhanced.

What is claimed is:

1. An image forming system comprising:

a sheet feeding section which feeds sheets;

an image data acquisition section which acquires image data of a plurality of pages;

an image forming section which carries out image formation on the sheets fed by the sheet feeding section based on the image data;

a cover sheet setting section which acquires a user input for setting a cover sheet;

a ring bookbinding section which performs a ring bookbinding to a bundle of sheets by using a ring binder;

a judging section which judges whether or not an image is to be formed by the image forming section on a last sheet of the bundle of sheets based on the user input for setting the cover sheet acquired by the cover sheet setting section; and a control section configured to control the sheet feeding section and the image forming section such that:

(i) when the judging section judges that an image is not to be formed by the image forming section on the last sheet of the bundle of sheets, the last sheet of the bundle of sheets, which is to be a rear cover sheet, is fed by the sheet feeding section before the image data acquisition section acquires the image data of a last page of the plurality of pages after job initiation and, after the sheet feeing section has fed the last sheet of the bundle of sheets, the image forming section begins forming images based on the image data onto a plurality of the sheets without forming an image on the last sheet of the bundle of sheets; and (ii) when the judging section judges that an image is to be formed by the image forming section on the last sheet of the bundle of sheets, which is to be the rear cover sheet, the image data acquisition section acquires at least the image data of the last page of the plurality of pages after job initiation, and then the image forming section carries out image formation on the plurality of sheets based on the image data.

2. The image forming system of claim 1, wherein the image data acquisition section comprises a scanner which reads originals continuously.

3. The image forming system of claim 1, wherein the image data acquisition section comprises a data receiving section which receives image data via a network.

4. The image forming system of claim 1, wherein the sheet feeding section includes (i) a sheet feeder provided upstream of the image forming section, the sheet feeder feeding a sheet on which the image is to be formed by the image forming section, and (ii) a sheet inserter provided downstream of the image forming section, the sheet inserter feeding a sheet on which the image is not to be formed by the image forming section; and wherein the judging section judges that the image is not to be formed by the image forming section on the last sheet of the bundle of sheets, when one of (i) the sheet feeder is designated as a cover sheet feeding source and a setting not to form the image on the cover sheet is designated through the cover sheet setting section, and (ii) when the sheet insertion section is designated through the cover sheet setting section as the cover sheet feeding source.

* * * * *